US005740665A

United States Patent [19]

Belton

[11] Patent Number: 5,740,665

[45] Date of Patent: Apr. 21, 1998

[54] RIDING SADDLES

[76] Inventor: Geoffrey Paul Belton, Albion House Caldmore Road, Walsall, England, WS1 3MR

[21] Appl. No.: 604,799

[22] Filed: Feb. 23, 1996

[30] Foreign Application Priority Data

Sep. 5, 1995 [GB] United Kingdom ..... 9518051

[51] Int. Cl.[6] ..... B68C 1/02

[52] U.S. Cl. ..... 54/44.1

[58] Field of Search ..... 54/44.1, 44.5, 54/44.7

[56] References Cited

U.S. PATENT DOCUMENTS

| | | | |
|---|---|---|---|
| 909,385 | 1/1909 | Fachiri | 54/44.1 |
| 4,324,090 | 4/1982 | Nix | 54/44.5 |

FOREIGN PATENT DOCUMENTS

| | | | |
|---|---|---|---|
| 0466270 | 9/1991 | European Pat. Off. | B68C 1/02 |
| 2162760 | 11/1971 | France | B68C 1/00 |
| 2664583 | 7/1990 | France . | |
| 248904 | 7/1912 | Germany | 54/44.7 |
| 2113520 | 12/1982 | United Kingdom | B68C 1/02 |
| 2171883 | 3/1986 | United Kingdom | B68C 1/02 |
| 2279546 | 4/1993 | United Kingdom | B68C 1/02 |

*Primary Examiner*—Robert P. Swiatek
*Attorney, Agent, or Firm*—Frost & Jacobs

[57] ABSTRACT

A riding saddle comprises, inter alia, two downwardly depending flaps from either side of the seat, which flaps may be altered to provide different configurations so that the saddle may be readily adapted for different riding pursuits. Such adaptability is provided by a generally two-part flap comprising a main part attached to the seat and a plurality of differently contoured removable parts releasably attachable to the main part, either in an aperture thereof, or at a front edge thereof. The invention provides a simple, quick, and relatively lowcost method of adapting a saddle to suit a variety of riding activities, such as show jumping, racing and dressage.

14 Claims, 4 Drawing Sheets

FIG 2
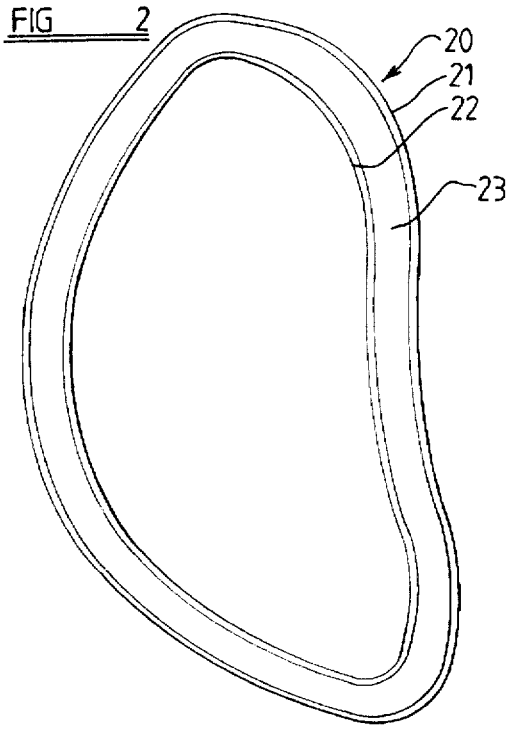
FIG 4
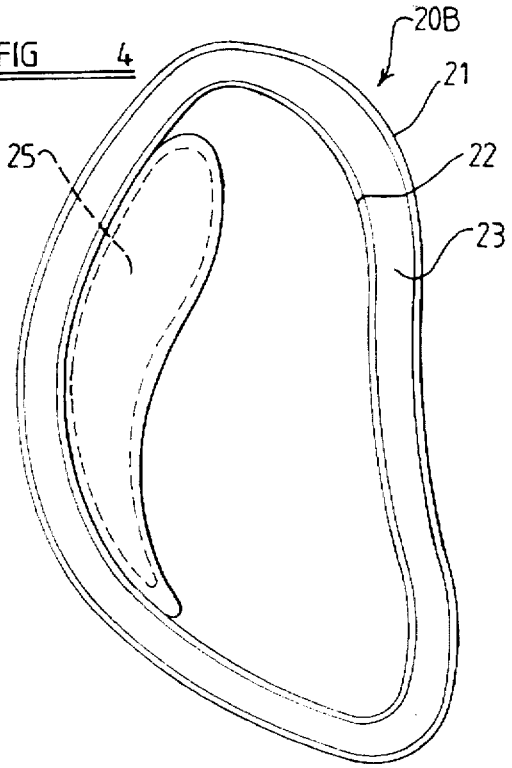
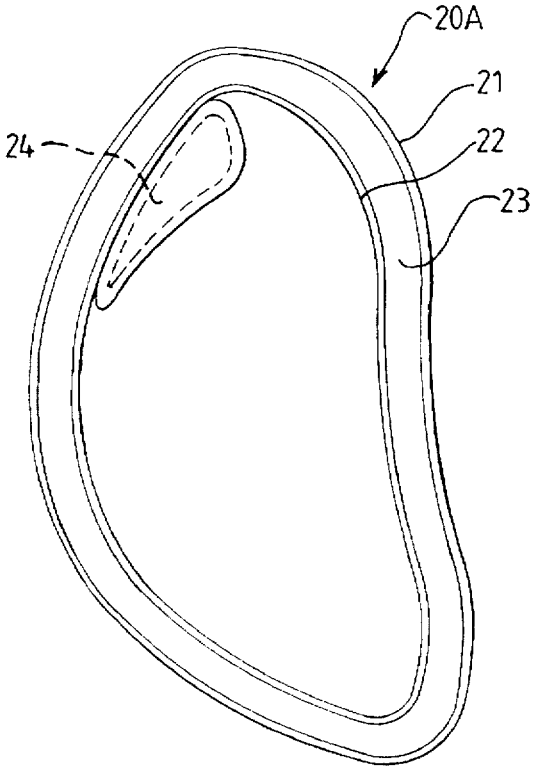
FIG 3
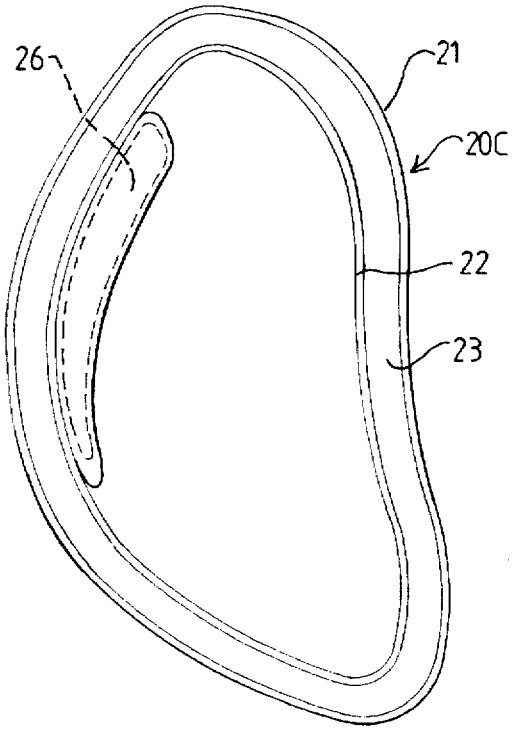
FIG 5

RIDING SADDLES

DESCRIPTION OF BACKGROUND TO THE INVENTION

This invention relates to riding saddles.

Conventionally, a riding saddle comprises a seat on which the rider sits and a panel beneath the seat which rests on and over the back of the horse or other animal for which the saddle is intended. The panel carries additionally, on each side of the seat, attachments for girth straps and stirrup straps, and in order to protect the rider's legs from discomfort or injury from such attachments a loose flap is provided on the side of the saddle to cover the panel and its attachments.

Customarily, the panel also usually carries a pair of blocks, one on each side of the seat, adjacent to the forward edge of the panel and beneath the flaps in order to contour the latter to provide for a better grip by the rider's legs. Such blocks may take various forms according to the intended purpose of the saddle and/or the size of the rider.

In the case of a saddle intended mainly for show jumping, such blocks are placed high up, near to the seat, and extend downwardly for only a short distance so as to engage the rider's legs only above the knee and allow the rider to ride in the saddle when jumping.

In the case of a saddle intended mainly for use in dressage, the blocks are much longer and extend along most of the front edge of the flaps to provide maximum contact with the rider's legs.

A general purpose saddle may have blocks of an intermediate size and shape.

However, in most cases, the blocks form a permanent part of the construction of the saddle and as a result a single saddle is not entirely satisfactory for a wide range of differing pursuits. However, many riders do follow a range of different pursuits and either have to choose a single saddle which is a compromise between the competing requirements of those different pursuits, or have to purchase two or more saddles, each specifically adapted for a particular pursuit.

DESCRIPTION OF THE PRIOR ART

It is known from GB2279546A and GB2171883A to provide a pocket in the flaps which is adapted to accommodate insert materials which contour an outwardly facing surface of the flap, thus effectively providing blocks of variable configuration such that the saddle may be used for a variety of riding pursuits, for example jumping and dressage.

However, such arrangements provide disadvantages since changing the inserts is relatively time consuming and requires careful positioning of the inserts so that the resulting formations are accurately positioned.

SUMMARY OF THE INVENTION

To obviate these disadvantages, I provide a riding saddle comprising a seat on which a rider can sit, a panel beneath the seat to rest on and over the back of a horse or other animal and a respective loose flap over the panel on each side of the seat, wherein the flaps each comprise a first, main, part and a second, removable part wherein the first part is attached to or integral with the seat, the first and second parts having mutually engagable releasable attachment means whereby the second part is releasably attachable at or adjacent a front edge of the first part.

There may be provided a plurality of differently contoured second, removable parts, each having a different outwardly facing surface configuration.

Accordingly, the saddle may retain a conventional overall appearance, but it may readily be adapted for different purposes by selecting an appropriate removable part for the pursuit being followed at any given time.

Preferably, the removable parts comprise a generally flat, flexible sheet of material which is releasably attachable to the main part so as to effectively form a continuation thereof. The removable parts preferably each comprise a contact portion and an attachment portion, wherein when the removable part is attached to the main part, the contact portion presents an outwardly facing surface which forms a continuation of the external surface of the main part for contact with the rider's legs, whereas the attachment portion is located beneath the main part of the flap.

It will be understood that the term "contact" refers to the fact that during normal use, this particular portion will be in contact with the rider's legs and it will accordingly comprise the formations necessary to contour the removable part as required, but that there may be provided a covering or layer of material over the contact portion so that it may not be directly in contact with the rider's legs.

Accordingly, the removable part may comprise, at least at the contact portion, two or more layers of material, there being provided a filler such as a block between two of the layers to provide the required contouring.

The attachment portion may also comprise two or more layers of material, there being provided on an outwardly facing layer thereof, fastening means enabling the removable part to be releasably attached to the main part.

In one arrangement, the flaps may each be formed with an aperture, adjacent to but spaced from the front edge of the flap, adapted to receive the contact portion of the removable part which is in the form of an insert corresponding in size and shape to the outline of said aperture. In such a case, the removable part may comprise an innermost layer of material having dimensions greater than those of the corresponding aperture, and an outermost layer having dimensions corresponding to those of the aperture to form said contact part and the peripheral marginal portion of the insert forms said attachment portion which may be brought into face to face engagement with an underside of the flap around the aperture so as to bring the fastening means on the insert into engagement with complementary fastening means around the aperture on the underside of the flap.

The attachment means may comprise any suitable form of conventional fastening means, including press studs or buttons, or a zip fastener, but in a preferred arrangement the fastening means comprise pairs of flexible strips of material having an array of closely spaced, small hooks on one strip, interengageable with loops on the other strip, e.g. of the kind available under the trade mark VELCRO.

In a second and preferred arrangement, the removable part is releasably attachable as a forward extension of the main part at the front edge of the main part. In such an arrangement, the fastening means preferably include directional fastening elements, such that the complementary parts of the fastening means, provided on an outwardly facing part of the attachment portion and an inwardly facing part of the front edge of the main part, may not engage with or be released from one another unless there is provided a relative degree of lateral movement between the complementary fastening means in a predetermined direction, in addition to the generally axial movement which is conventionally required.

Such fasteners may comprise press studs, formed to give the required directionality.

It is preferred that the directional press studs be provided at positions on the attachment portion generally at or near the top and bottom thereof, and at corresponding positions on the main part. Desirably, there may be provided more than one such fastening means at both the top and bottom of the attachment portion and the main part.

Preferably in addition to such directional fastening elements the fastening means also includes so called "hook and loop" fasteners, commonly available under the trade mark VELCRO.

BRIEF DESCRIPTION OF THE DRAWINGS

These and other features of the invention will now be described by way of example with reference to the accompanying drawings wherein:

FIGS. 2 to 5 illustrate four different forms of insert which may be used with such saddle;

DESCRIPTION OF THE PREFERRED EMBODIMENTS

Figure 1:
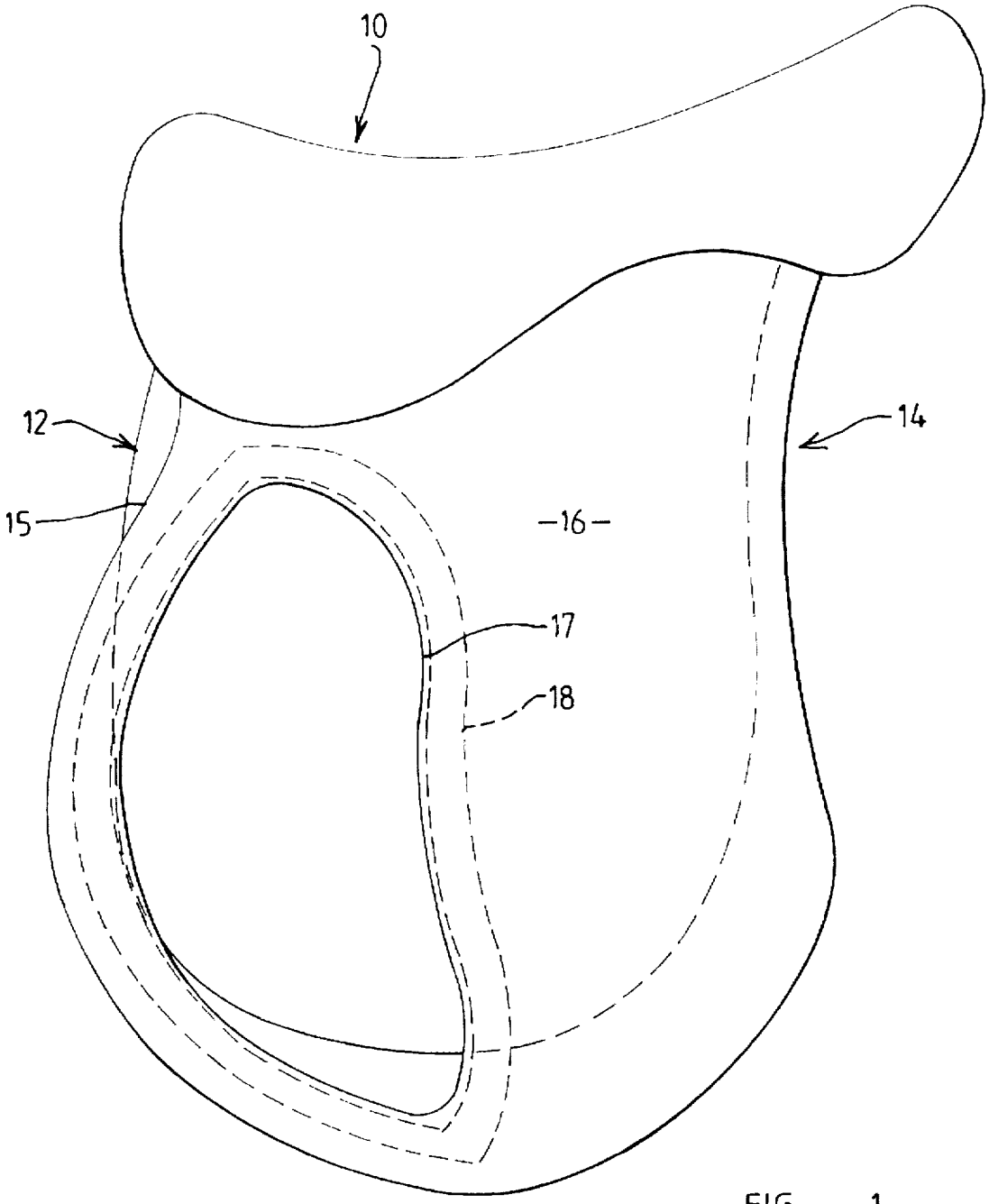
FIG. 1 shows a side view of a saddle constructed in accordance with the invention and having flaps adapted to receive interchangeable inserts to adapt it for different types of riding, the panel in FIG. 1 being illustrated without any insert in place.

As illustrated, a preferred embodiment of saddle in accordance with the invention comprises a seat 10 of generally conventional form and a panel 12 which extends beneath the seat and downwardly on opposite sides thereof in conventional manner. Also, in conventional manner, the saddle includes a pair of flaps 14 (only one of which is shown) to overlie the opposite sides of the panel 12.

In accordance with the invention, each flap 14 is formed as two separable parts whereby a contact portion thereof adjacent to the forward edge 15 of the flap can be removed from the main part thereof and replaced easily as and when required. In the embodiment illustrated in FIGS. 1 to 5 each flap comprises a main part 16 of generally conventional outline having a shaped opening 17 towards the front edge thereof. Around the periphery of the opening 17, on the underface of the flap 14, there is provided a preferably substantially continuous strip 18 of fastening material of the kind generally known by the trade mark VELCRO.

In accordance with the invention the contact portion of the flap comprises various inserts 20, 20A, 20B, 20C which are provided for assembly with the main parts 16 of the flaps 14. In each case, the insert 20, 20A, 20B, 20C comprises an inner layer 21 which generally corresponds in shape to the shape of the opening 17, but is of greater dimensions, and an outer layer 22 which again corresponds in shape to the shape of the opening 17, but is so dimensioned as to fit within the opening and effectively form an extension of the outer surface of the main part of the flap 14.

The marginal portion of the inner layer 21 comprises an attachment portion which carries a preferably substantially continuous strip 23 of complementary fastening material to adhere releasably to the fastening material 18 around the periphery of the opening 17 at the underside of the flap 14.

Thus, each of the inserts 20, 20A, 20B, 20C can be assembled with the main part of the flap 14 so that the outer layer 22 thereof is disposed in the opening 16 to form an effective continuous extension of the outer surface of the flap and serve as a contact portion for the rider's legs.

The insert 20 shown in FIG. 2 is of substantially flat form, whereas the inserts 20A, 20B, and 20C shown in FIGS. 3,4 and 5 respectively are contoured by the insertion between the inner and outer layers of respective fillers, in this case blocks 24,25,26, so that insert 20A is specifically adapted to use in show jumping, insert 20B for use in dressage work, and insert 20C for general purpose usage. It will be appreciated that these forms are representative of many others that may be made available.

Whilst in the illustrated embodiment the inserts are of such a size as to form a substantial part of the overall area of each flap, it will be appreciated that the opening in the flap may be significantly smaller, so as to be sufficient to accommodate only the area in which variable contouring may be required.

Figure 6:
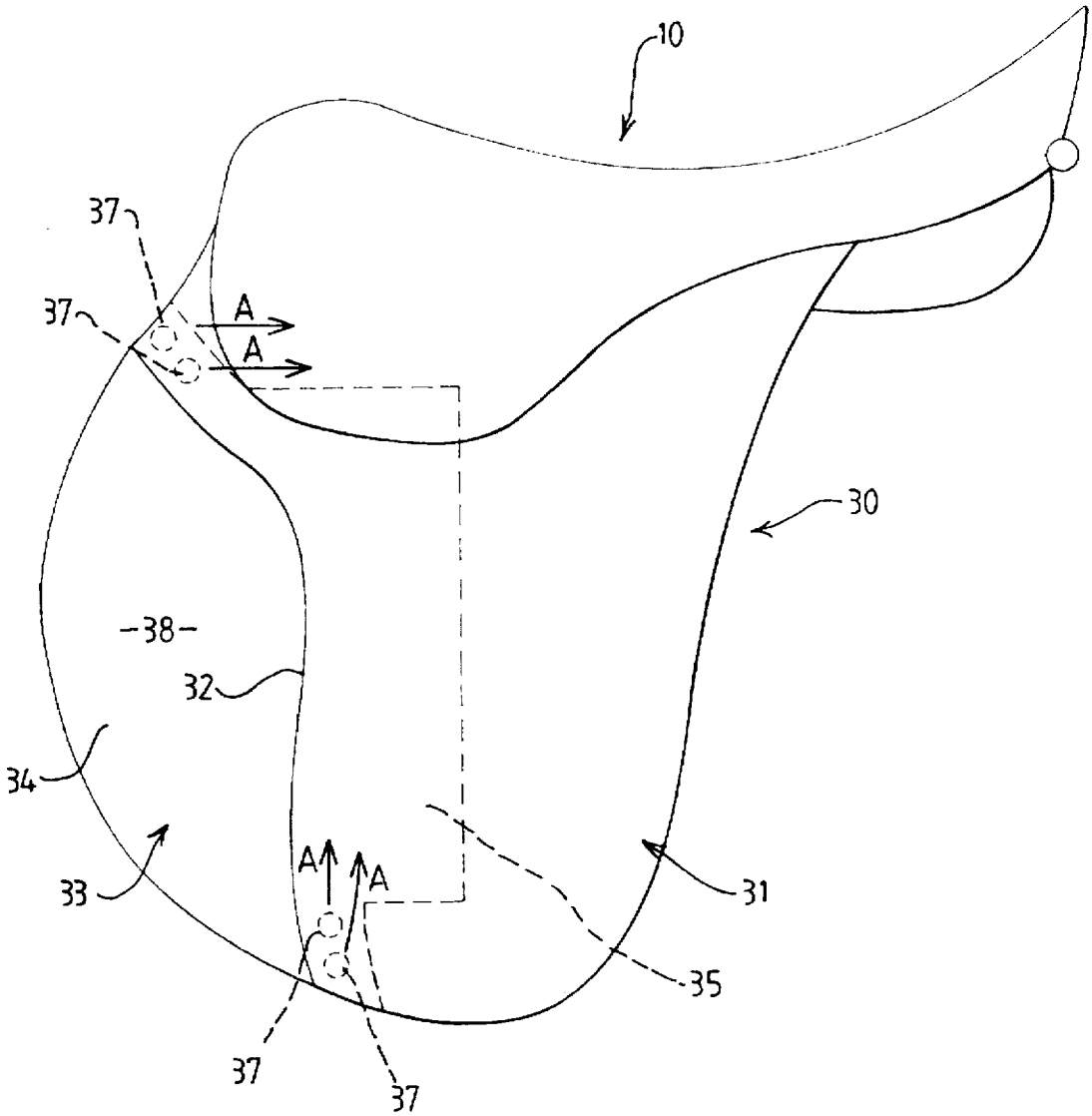
FIG. 6 shows an alternative embodiment of a saddle having flaps comprising a main part and a removable part.

Referring now to FIG. 6, there is shown a second embodiment of a saddle comprising a seat 10, and flaps 30 which extend downwardly from either side of the seat, only one of which is shown. The flap 30 is attached to the seat in generally conventional manner, as shown in FIG. 1. However the flap 30 in this case comprises a first, main, part 31 having a front edge 32 which, as will be seen by reference to FIG. 1, represents a reduction in area of the flap 30 when compared to flap 14 of FIG. 1. There is further shown a second, removable extension part 33 having a contact portion 34 for contact with the rider's legs and an attachment portion 35 for releasable attachment of the part 33 to the part 31. The contact portion 34 presents an outwardly facing surface 38, which may be formed of the same material as that of the main part 31 or of a contrasting material.

The attachment portion 35 comprises a tongue which is adapted to locate behind the main part 31 such that the extension part 33 may be attached to the main part by virtue of complementary fastening means 36, 37 provided on an outwardly facing surface of the attachment portion 35 and an inwardly facing surface of the main part 31.

In this embodiment the fastening means comprise both a plurality of pairs of directional press studs 37, and sheets of fastening material in the form of a hook and loop fastener, commonly known by the trade mark VELCRO, indicated by reference numeral 39, which serves to provide additional securement of the extension part 33 to the main part 31 of the flap 30.

One part of each press stud 37 is provided on the outer face of the attachment portion, 35 and the complementary part of each press stud 37 is provided on the inner face of the main part 31. The press studs are directional to the extent that in order for the complementary parts to be released from one another, relative lateral movement is required therebetween in addition to the axial movement to separate the complementary parts, as indicated by the arrows A, although it will be appreciated that the direction of arrows A is purely exemplary.

Figure 7:
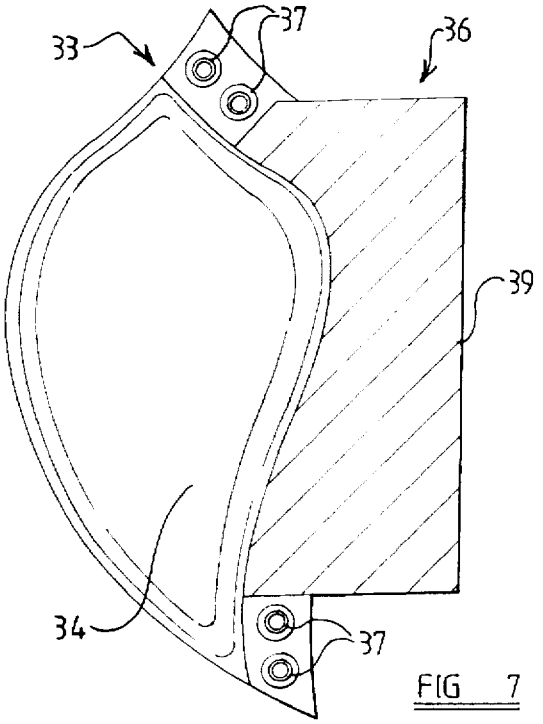
FIGS. 7 to 10 illustrate four different types of removable part which may be used with a saddle as shown in FIG. 6.

The removable part 33 shown in FIG. 6 and in more detail in FIG. 7 is of substantially uncontoured form, but the removable part may incorporate blocks, as shown in more detail in FIGS. 8 to 10, the blocks having the same purpose as those described with reference to FIGS. 1 to 5. In use, a rider's leg effectively abuts a rearwardly facing surface 41 of the filler, thus imparting a force on the filler in a generally forward direction. The directional fastening means are thus orientated and/or formed such that in order for the complementary fastening means to be released from one another, the lateral force required must be in a different direction to the direction of the force applied by a rider to the rearwardly facing surface 41 of the filler, such that the complementary fastening means do not separate when the saddle is in use by the rider.

Figure 9:
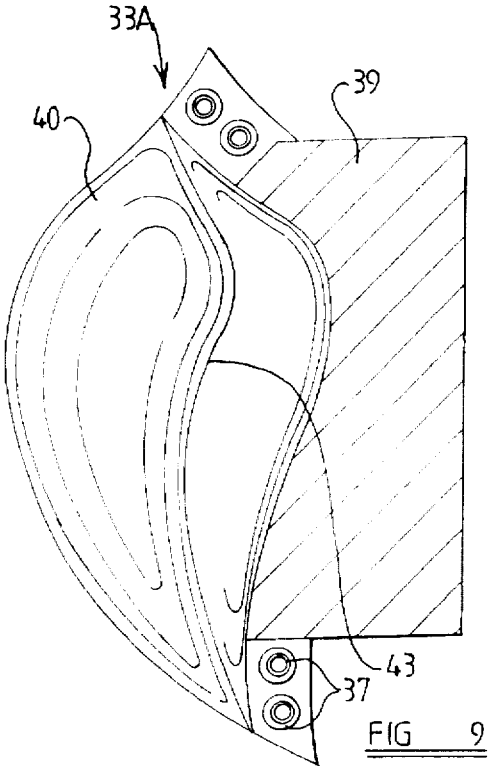
Figure 8:
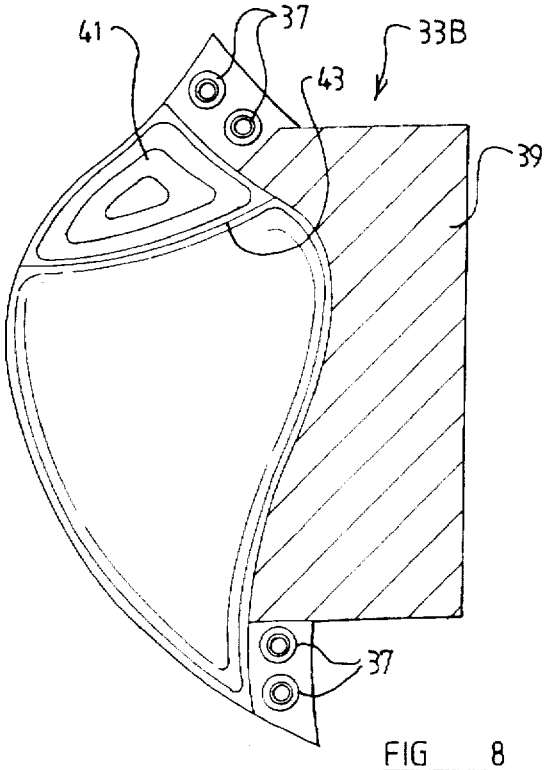
Figure 10:
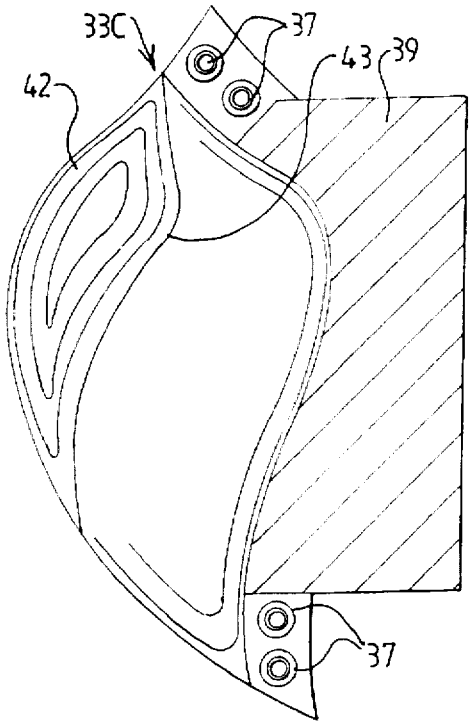

FIGS. 8 to 10 show various embodiments 33A, 33B and 33C extension parts which differ by the provision of differently shaped fillers 40, 41, 42 on the contact portion 34 of the removable parts 33. It is anticipated that any required shape of filler may be provided on the contact portion 34, as dictated by the type of riding which is required. Indeed, as shown in FIG. 7, it may be that no filler at all is required, such that the exposed portion is generally flat.

It will be appreciated that by interchanging the insert 20 or extension part 33, a single saddle may readily be adapted for a variety of purposes and that no skill is required so that the inserts or extensions as appropriate can be interchanged by the rider in the field at any time during events having stages calling for different configurations of filler. Also, the facing material of the insert 20 or extension 33 can be made of a more durable material than that of the main part of the flaps, since this is where the greater wear occurs, without the extra cost that would arise were the entire flap to be faced with such a more durable material. Moreover should the material of which the insert is made become worn or damaged, the insert can readily be replaced at minimum cost.

It is particularly advantageous for the aperture in the flap or "cut away" section of the front edge to be substantially wider than the filler itself since the portion of the flap adjacent to the filler may be subjected to greater wear than other parts of the flap, and such an arrangement enables a worn portion of the removable part adjacent to the filler to be replaced. However, it will be understood that the aperture in the saddle may be dimensioned and shaped so as to correspond with the outline of the largest filler to be used.

In particular, the invention provides an inexpensive way of customising saddles to an individual rider's requirements.

The features disclosed in the foregoing description the following claims or the accompanying drawings, expressed in their specific forms or in terms of a means for performing the disclosed function, or a method or process for attaining the disclosed result, or a class or group of substances or compositions, as appropriate, may, separately, or in any combination of such features, be utilised for realising the invention in diverse forms thereof.

I claim:

1. A riding saddle comprising a seat on which a rider can sit, a panel beneath the seat to rest on and over the back of a horse or other animal and a respective loose flap over the panel on each side of the seat, wherein the flaps each comprise a first, main, part and a plurality of differently contoured second, removable parts, each having a different outwardly facing surface configuration, wherein the first part is attached to or integral with the seat, the first and second parts having mutually engageable releasable attachment means whereby each of said second parts is releasably attachable at or adjacent a front edge of the first part.

2. A riding saddle according to claim 1 wherein the removable parts each comprise a generally flat, flexible sheet of material which is releasably attachable to the main part so as to effectively form a continuation thereof.

3. A riding saddle according to claim 2 wherein the removable parts each comprise a contact portion and an attachment portion, wherein when the removable part is attached to the main part, the contact portion presents an outwardly facing surface which forms a continuation of the external surface of the main part for contact with the rider's legs, whereas the attachment portion is located beneath the main part of the flap.

4. A riding saddle according to claim 3 wherein each removable part comprises, at least at the contact portion, two or more layers of material, there being provided a filler between two of the layers to provide the required contouring.

5. A riding saddle according to claim 3 wherein the attachment portion also comprises two or more layers of material, there being provided on an outwardly facing layer thereof, fastening means enabling the removable part to be releasably attached to the main part.

6. A riding saddle according to claim 3 wherein the flaps are each formed with an aperture, adjacent to but spaced from a front edge of the flap, adapted to receive the contact portion of the removable part which is in the form of an insert corresponding in size and shape to the outline of said aperture.

7. A riding saddle according to claim 6 wherein each removable part comprises an innermost layer of material having dimensions greater than those of the corresponding aperture, and an outermost layer having dimensions corresponding to those of the aperture to form said contact part and the peripheral marginal portion of the insert forms said attachment portion which may be brought into face to face engagement with an underside of the flap around the aperture so as to bring the fastening means on the insert into engagement with complementary fastening means around the aperture on the underside of the flap.

8. A riding saddle according to claim 3 wherein each removable part is releasably attachable as a forward extension of the main part at the front edge of the main part.

9. A riding saddle according to claim 1 wherein the attachment means comprises any suitable form of conventional fastening means.

10. A riding saddle according to claim 9 wherein the fastening means comprise pairs of flexible strips of material having an array of closely spaced, small hooks on one strip, interengagable with loops on the other strip.

11. A riding saddle according to claim 9 wherein the fastening means includes directional fastening elements, such that the complementary parts of the fastening means, provided on an outwardly facing part of the attachment portion and an inwardly facing part of the front edge of the main part, may not engage with or be released from one another unless there is provided a relative degree of lateral movement between the complementary fastening means in a predetermined direction, in addition to the generally axial movement which is conventionally required.

12. A riding saddle according to claim 11 wherein fasteners comprise press studs, formed to give the required directionality.

13. A riding saddle according to claim 12 wherein the directional press studs are provided at positions on the attachment portion generally at or near the top and bottom thereof, and at corresponding positions on the main part.

14. A riding saddle according to claim 11 wherein there are provided more than one such fastening means at both the top and bottom of the attachment portion and the main part.

* * * * *